US010774692B2

(12) United States Patent
Geyer et al.

(10) Patent No.: US 10,774,692 B2
(45) Date of Patent: Sep. 15, 2020

(54) TAPPET

(71) Applicant: Schaeffler Technologies AG & Co. KG, Herzogenaurach (DE)

(72) Inventors: Norbert Geyer, Höchstadt (DE); Alexander Fichtner, Memmelsdorf (DE); Georg Backert, Mühlhausen (DE); Michael Dotterweich, Burgebrach (DE); Matthias Reichel, Obertrubach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/607,918

(22) PCT Filed: Mar. 8, 2018

(86) PCT No.: PCT/DE2018/100211

§ 371 (c)(1),
(2) Date: Oct. 24, 2019

(87) PCT Pub. No.: WO2018/206029

PCT Pub. Date: Nov. 15, 2018

(65) Prior Publication Data

US 2020/0095901 A1 Mar. 26, 2020

(30) Foreign Application Priority Data

May 8, 2017 (DE) ..... 10 2017 109 761

(51) Int. Cl.

| | |
|---|---|
| ***F01L 1/18*** | (2006.01) |
| ***F01L 1/14*** | (2006.01) |
| ***F02M 59/10*** | (2006.01) |

(52) U.S. Cl.
CPC ..... *F01L 1/14* (2013.01); *F02M 59/102* (2013.01); *F01L 2305/00* (2020.05)

(58) Field of Classification Search
CPC ..... F01L 1/14; F01L 2105/00; F01L 2305/00; F02M 59/102; F04B 53/14
See application file for complete search history.

(56) References Cited

U.S. PATENT DOCUMENTS

| | | | | |
|---|---|---|---|---|
| 5,566,652 | A | 10/1996 | Deppe | |
| 2013/0068064 | A1* | 3/2013 | Geyer | F02M 59/102 74/569 |
| 2016/0091074 | A1 | 3/2016 | Berruet et al. | |

FOREIGN PATENT DOCUMENTS

| | | | |
|---|---|---|---|
| DE | 3519015 | A1 | 11/1986 |
| DE | 102012211529 | A1 | 1/2014 |

(Continued)

*Primary Examiner* — Zelalem Eshete
(74) *Attorney, Agent, or Firm* — Matthew V. Evans

(57) ABSTRACT

A tappet is proposed, for a fuel pump or for a valve timing gear, in each case of an internal combustion engine, comprising a hollow-cylindrical housing, which includes two separate portions lying in line one after the other, which are fitted together in a region of their facing inner faces and are permanently connected to one another by way of a joint. The tappet has a roller on its driving side and an abutment for a follower part on its driven side, which abutment is formed on a separate insert. The abutment is radially supported on the housing in the fitted-together region of the two portions, wherein the insert has a middle annular collar, from which on the one hand a sleeve portion protrudes in the direction of the driving side and on the other hand a dome-like attachment protrudes towards the driven side.

14 Claims, 2 Drawing Sheets

(56) References Cited

FOREIGN PATENT DOCUMENTS

| | | | |
|---|---|---|---|
| DE | 102013204178 | A1 | 9/2014 |
| DE | 102014218961 | A1 | 3/2016 |

* cited by examiner

TAPPET

CROSS-REFERENCE TO RELATED APPLICATIONS

This application is the U.S. National Phase of PCT Application No. PCT/DE2018/100211 filed on Mar. 8, 2018 which claims priority to DE 10 2017 109 761.9 filed on May 8, 2017, the entire disclosures of which are incorporated by reference herein.

TECHNICAL FIELD

This disclosure concerns a tappet for a fuel pump or for a valve timing gear, in each case of an internal combustion engine. The tappet includes a hollow cylindrical housing comprising two separate portions which lie successively in alignment. The two separate portions are joined together in the region of their facing inner faces and are permanently connected together via a joint. The tappet has a roller on its drive side and an abutment for a follower part on its output side, which abutment is formed on a separate insert that is radially supported on the housing in the joined region of the two portions.

BACKGROUND

Such a tappet is shown in FIG. 2 of US 2016/0091074. The insert with abutment is configured as a thick-walled disc which bears on a floor of the pot-like housing portion on the output side. The drive-side housing portion is a solid part and on one side extends with an annular region over a bottom-side diameter reduction of the output-side portion. On the other side, two tabs protrude from the drive-side housing portion (see also FIG. 7) in the drive direction to receive a roller bolt which is fixed axially by an additional ring cap surrounding the tabs.

The above-mentioned tappet is constructed comparatively solidly and is overly complex in structure. Adaptation to different or greater installation lengths (e.g. for cam drives on the crankshaft side) is extremely difficult. It has also been found that the disc can detach in some cases, at least during transport of the tappet. Also, because of the stepping in the central region, the assembled housing of the tappet only has an inadequate guide length for its support.

A further tappet consisting of two successively aligned portions is disclosed in DE 10 2014 218 961 A1. The abutment for the follower part is formed directly on a bottom of the output-side portion.

DE 35 19 015 A1 discloses a tappet with a separately joined base plate for a cam run-up. An annular flange protrudes from an inner casing of a shroud of the tappet and receives a hydraulic play-adjustment element for a follower member contact.

A one-piece tappet is described in DE 10 2013 204 178 A1. A plate is applied to the housing axially below the roller for a cam run-up, and a pump piston bears against the lower face of said plate when installed.

SUMMARY

It is an object of this disclosure to create a simply structured tappet which is easy to install and has good guide properties, and which can also very easily be adapted to different installation lengths.

According to the disclosure, this object is achieved in that the insert has a central annular collar, from which on one side a sleeve portion protrudes in the direction of the drive side, and from which on the other side a dome-like attachment protrudes towards the output side. The radial support is provided at the joined region of the two portions by an outer ring of the annular collar. For the axial support of the insert, an outer face of the sleeve portion rests on at least one radial indentation of the drive-side portion, and an end face of the dome-like attachment has the abutment for the follower part.

Thus, a simply constructed tappet is provided with a good guide length. With unchanged basic type of one of the housing portions, such as the part carrying the roller, different fuel pump types can be served by pairing second portions with inserts of different "height".

The insert described herein consists firstly of the central annular collar from which a sleeve portion protrudes axially in one direction and bears axially on indentations of the housing, such as on undersides of the indented housing flat carrying the roller bolt. On the other side, the insert has a dome-like attachment with end-side abutment for the pump piston. By varying a height of this attachment, the tappet can very easily be adapted to different installation lengths. Said attachment may also protrude beyond the housing or lie "deeper" than its output-side annular edge.

According to one embodiment, the tappet has an installation height which corresponds to at least 1.8 times its outer diameter. This installation height is measured between an upper edge of the roller and an output-side outer face of the housing. The outer diameter is placed on the outer casing of the pump-side portion of the housing.

By joining the two portions together according to the disclosure by means of joints produced e.g. by welding, and by simultaneous radially inner support of the insert via its annular collar in this portion, a good stability of the connection is guaranteed.

To allow good guidance of the tappet unaffected by the joint, it is proposed to create a groove (constriction) in the connecting region of the housing portions, which groove then contains the weld for example. In some cases, the insert may also be welded here.

Suitably, the radially inner part of the joined portions has a radially inwardly bent collar. This serves for additional reinforcement of the structure.

BRIEF DESCRIPTION OF THE DRAWINGS

The disclosure is shown in the drawings. The drawings show.

DETAILED DESCRIPTION

Figure 1:
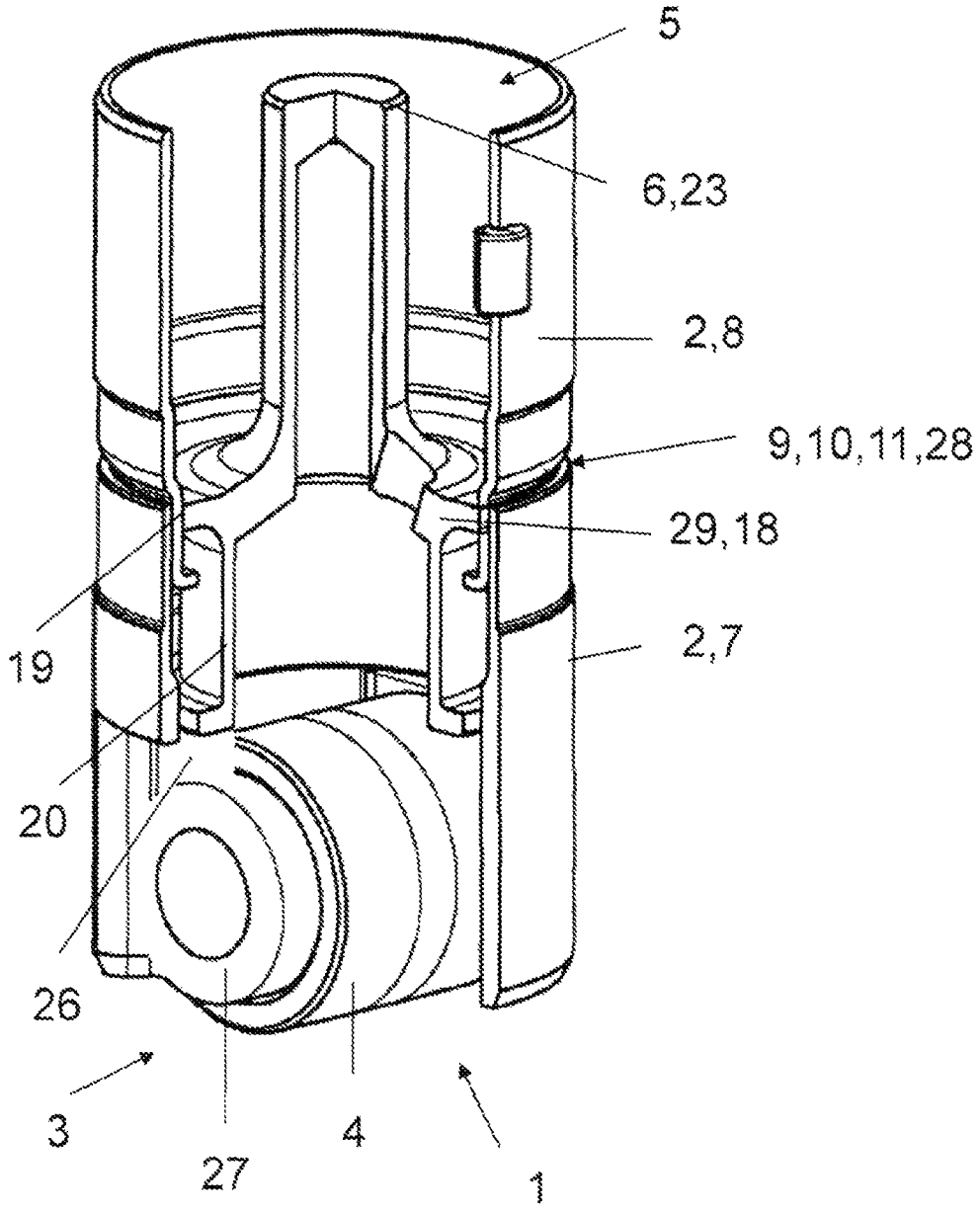
FIG. 1: a spatial, partly broken away view of the tappet.

A tappet 1 for a high-pressure fuel pump of an internal combustion engine is shown. It comprises a two-piece, substantially hollow cylindrical housing 2.

On its drive side 3, the tappet 1 has a roller 4 mounted on a bolt 27 for contact with a cam or a cam package on a crankshaft of the internal combustion engine. On its output side 5, the tappet 1 has an abutment 6 formed as part of a separate insert 29 which is supported radially and axially on the housing 2, for a follower part (pump piston).

As the two figures clearly show, the housing 2 is constructed from two separate portions 7, 8 lying successively in alignment. These are joined together in the region of their facing end faces 9, 10, and connected together via a weld 11. The weld 11 lies in a groove-shaped indentation 28 axially between the portions 7, 8, and thus does not influence an outer casing of the housing 2.

Two portions 7, 8 of the housing 2 consist of a thin-walled sheet steel. In contrast to metal tappets previously produced, because of the "alignment" of the two portions 7, 8, the tappet 1 has a length which is around twice as large as its diameter. It is therefore ideally suited but not exclusively designed for crankshaft-driven injection pumps with relatively large distances, imposed by the design, between the respective cams or eccentrics on the crankshaft and the pump piston of the injection pump to be driven.

Figure 2:
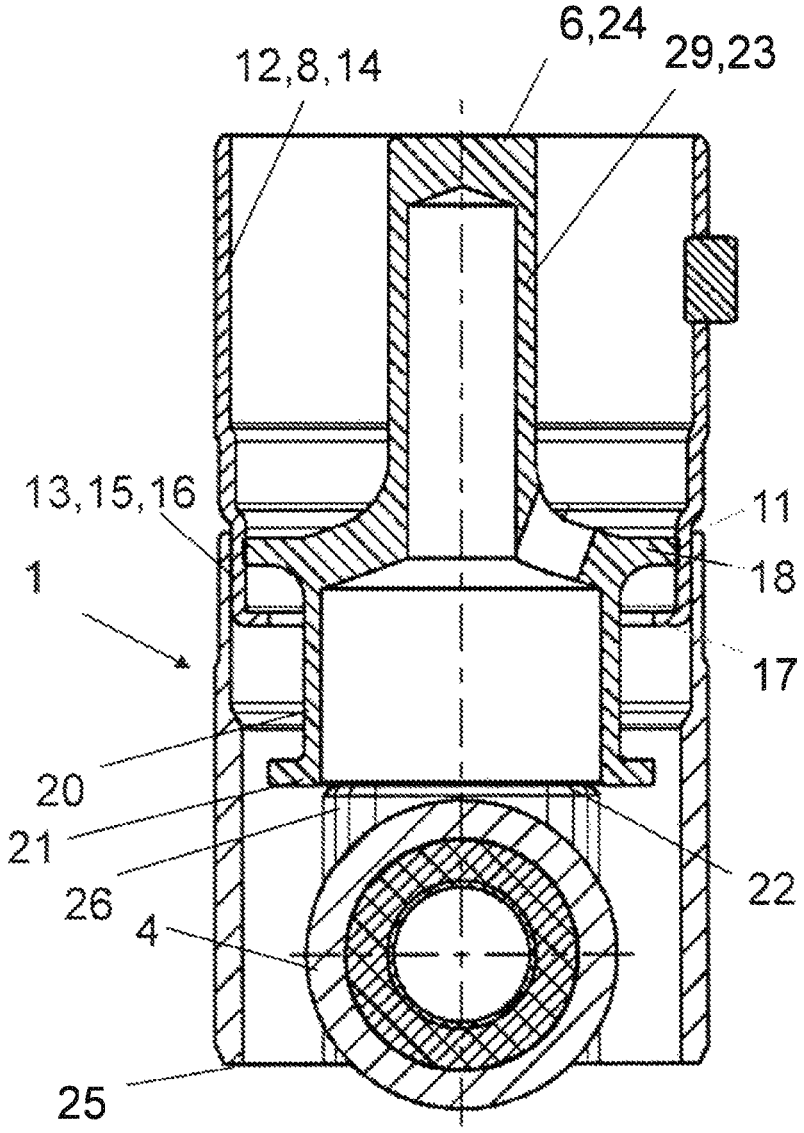
FIG. 2: the above-mentioned tappet in longitudinal section.

FIG. 2 shows that a shroud 12 of the output-side portion 8 consists substantially of two annular stages 13, 14. The "lower" annular stage 13 of smaller outer diameter runs in the axial portion of the joint 11, and on the end side has a radially inwardly oriented stiffening collar 17. Said stage lies with its outer casing 15 on an inner casing portion 16 at the inner face 9 of the other drive-side portion 7.

The insert 29 mentioned above in the description of the figures has a central plate-like annular collar 18 which is radially supported in the joint region via its outer ring 19.

On one side, a central sleeve portion 20 protrudes from the annular collar 18 in the direction towards the drive side 3. Its free outer face 21 is axially supported on two radial indentations 22 of the portion 7. More precisely, two flats 26 indented from the outer casing start from a drive-side face 25 of the housing 2 diametrically opposite each other. The bolt 27 carrying the roller 4 is mounted therein. The undersides of the flats 26 function as the radial indentations 22.

Also, a dome-like attachment 23 protrudes from the annular collar 18 of the insert 29 through the output-side portion 8 of the housing 2. An end face 24 of the attachment 23 forms the abutment 6 for the pump piston.

LIST OF REFERENCE CHARACTERS

1) Tappet
2) Housing
3) Drive side
4) Roller
5) Output side
6) Abutment
7) Portion
8) Portion
9) Inner face
10) Inner face
11) Joint, weld
12) Shroud
13) Annular stage
14) Annular stage
15) Outer casing
16) Inner casing portion
17) Stiffening collar
18) Annular collar
19) Outer ring
20) Sleeve portion
21) Outer face
22) Radial indentation
23) Attachment
24) End face
25) Face
26) Flat
27) Bolt
28) Indentation
29) Insert

The invention claimed is:

1. A tappet for a fuel pump or for a valve timing gear, in each case of an internal combustion engine, the tappet comprising:
- a hollow cylindrical housing having two separate portions which lie successively in alignment, the two portions joined together in a joined region of their facing inner faces and permanently connected together via a joint;
- a roller on a drive side of the cylindrical housing;
- an abutment configured for a follower part on an output side of the cylindrical housing, the abutment formed on a separate insert that is radially supported on the cylindrical housing in the joined region of the two portions, the insert having:
  - a central annular collar including:
    - a first side from which a sleeve portion protrudes in a direction of the drive side; and
    - a second side from which a dome-like attachment protrudes towards the output side;
    - wherein the insert is;
      - radially supported at the joined region of the two portions by an outer ring of the annular collar; and
      - axially supported by an outer face of the sleeve portion that rests on at least one radial indentation of a drive-side portion of the two portions; and
    - an end face of the dome-like attachment has the abutment configured to engage the follower part.

2. The tappet as claimed in claim 1, wherein two indented, diametrically opposed flats start from a drive-side face of the housing and receive a bolt carrying the roller, and the at least one radial indentation is formed on undersides of the flats.

3. The tappet as claimed in claim 1, wherein the tappet has an installation height which corresponds to at least 1.8 times its outer diameter.

4. The tappet as claimed in claim 1, wherein a shroud of one of the two portions includes at least two annular stages, and one of the at least two annular stages with a smallest outer diameter runs in an axial portion of the joint with its outer casing joined to an inner casing portion at an inner face of the other portion.

5. The tappet as claimed in claim 4, wherein on an end side, a radially inwardly oriented stiffening collar starts from a free end of the one of the at least two annular stages with the smallest outer diameter.

6. The tappet as claimed in claim 1, wherein the two portions are joined together by welding, soldering or bonding.

7. The tappet as claimed in claim 6, wherein a welding joint or soldering joint formed by joining the two portions lies in a groove-shaped indentation on the inner faces of the two portions.

8. A tappet for a fuel pump or a valve timing gear, the tappet comprising:
- a hollow cylindrical housing having two separate portions which lie successively in alignment, the two portions joined together in a joined region and permanently connected together;
- a roller on a drive side of the cylindrical housing;
- an abutment arranged on an output side of the cylindrical housing and configured to engage a follower part, the abutment formed on a separate insert having:
  - a central annular collar including:
    - a first side from which a sleeve portion protrudes in a direction of the drive side of the cylindrical housing; and a second side from which a dome-like attachment protrudes towards the output side of the cylindrical housing; and the separate insert radially supported by the joined region of the cylindrical housing, and axially supported by a drive-side portion of the cylindrical housing.

9. The tappet of claim 8, wherein an end face of the dome-like attachment forms the abutment configured to engage the follower part.

10. A tappet for a fuel pump or a valve timing gear, the tappet comprising:

a hollow cylindrical housing having two separate portions which lie successively in alignment, the two portions including an output side portion and a drive side portion that are joined together in a joined region;

a roller arranged within the drive side portion; and an abutment formed on a separate insert and configured to engage a follower part, the abutment radially supported by an inner surface of the joined region and axially supported by the drive side portion.

11. The tappet of claim 10, wherein the joined region comprises facing end faces of the output side portion and the drive side portion.

12. The tappet of claim 11, wherein the output side portion comprises two annular stages including an upper annular stage and a lower annular stage, the lower annular stage: i) having a smaller outer diameter than the upper annular stage; and, ii) forming the joined region with the drive side portion.

13. The tappet of claim 11, wherein the output side portion and the drive side portion form a groove in the joined region, the groove configured to receive a weld to permanently connect the output side portion to the drive side portion.

14. The tappet of claim 10, wherein the separate insert comprises a central annular collar, the central annular collar including:

a first side from which a sleeve portion protrudes in a direction of the drive side of the cylindrical housing; and a second side from which an attachment protrudes towards the output side of the cylindrical housing, an end face of the attachment has the abutment configured to engage the follower part.

* * * * *